US009713395B2

(12) United States Patent
Pichel

(10) Patent No.: US 9,713,395 B2
(45) **Date of Patent: *Jul. 25, 2017**

(54) MERCHANDISING SYSTEM WITH PUSHER ASSEMBLY

(71) Applicant: Display Technologies, LLC, Lake Success, NY (US)

(72) Inventor: Matthew Pichel, Englewood, NJ (US)

(73) Assignee: Display Technologies, LLC, Lake Success, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/213,798

(22) Filed: Jul. 19, 2016

(65) Prior Publication Data

US 2016/0324334 A1 Nov. 10, 2016

Related U.S. Application Data

(63) Continuation-in-part of application No. 14/725,012, filed on May 29, 2015, now Pat. No. 9,392,882, (Continued)

(51) Int. Cl.

| | |
|---|---|
| ***A47F 1/04*** | (2006.01) |
| ***A47F 1/12*** | (2006.01) |
| ***A47F 5/00*** | (2006.01) |

(52) U.S. Cl.

CPC ..... *A47F 1/126* (2013.01); *A47F 1/125* (2013.01); *A47F 5/005* (2013.01); *A47F 5/0018* (2013.01); *A47F 5/0025* (2013.01)

(58) Field of Classification Search

CPC .... A47F 1/04; A47F 1/12; A47F 1/125; A47F 1/126; A47F 5/0018; A47F 5/005; A47F 5/0025

(Continued)

(56) References Cited

U.S. PATENT DOCUMENTS 4,300,693 A * 11/1981 Spamer ..... A47F 1/126 211/59.3
4,303,162 A * 12/1981 Suttles ..... A47F 1/126 211/59.3

(Continued)

FOREIGN PATENT DOCUMENTS

EP 478570 A1 4/1992
EP 0478570 B1 * 12/1995 ..... A47F 1/126

(Continued)

OTHER PUBLICATIONS

International Search Report PCT/US14/40656.
European Search Report dated Apr. 19, 2017 issued in corresponding EP Application No. 14810602.

*Primary Examiner* — Stanton L Krycinski
(74) *Attorney, Agent, or Firm* — Carter, DeLuca, Farrell & Schmidt, LLP

(57) ABSTRACT

A merchandising system including a track and a pusher. The track defines a longitudinal axis and includes a plurality of tabs. Each tab of the plurality of tabs includes a width that is perpendicular to the longitudinal axis. The pusher member is configured to slide longitudinally with respect to the track. The pusher member includes at least one leg configured to mechanically engage the track. The track includes a discontinuity to facilitate removal of the pusher member from the track. The discontinuity includes at least one other tab having a width less than a width of an adjacent tab of the plurality of tabs.

20 Claims, 16 Drawing Sheets

Related U.S. Application Data which is a continuation of application No. 13/915,134, filed on Jun. 11, 2013, now Pat. No. 9,107,516.

(58) Field of Classification Search
USPC .... 211/49.1, 59.2, 59.3, 59.4; 221/226, 279, 221/124
See application file for complete search history.

(56) References Cited

U.S. PATENT DOCUMENTS 4,729,481 A * 3/1988 Hawkinson ..... A47F 1/126 211/59.3
4,742,936 A * 5/1988 Rein ..... A47F 1/126 116/278
4,830,201 A * 5/1989 Breslow ..... A47F 5/005 211/184
4,899,893 A * 2/1990 Robertson ..... A47F 1/126 211/59.3
4,958,739 A * 9/1990 Spamer ..... A47F 1/12 211/153
4,997,094 A * 3/1991 Spamer ..... A47F 1/12 211/153
5,024,336 A * 6/1991 Spamer ..... F16B 12/10 211/153
5,069,349 A * 12/1991 Wear ..... A47F 1/126 211/194
5,190,186 A * 3/1993 Yablans ..... G07F 11/60 221/124
5,240,126 A * 8/1993 Foster ..... A47F 1/126 211/175
5,366,099 A * 11/1994 Schmid ..... A47F 1/126 211/175
5,562,217 A * 10/1996 Salveson ..... A47F 1/126 211/175
5,634,564 A * 6/1997 Spamer ..... A47F 1/126 211/175
5,685,664 A * 11/1997 Parham ..... A47F 1/126 211/59.3
5,855,281 A * 1/1999 Rabas ..... A47F 5/005 211/175
6,129,218 A * 10/2000 Henry ..... A47F 5/005 211/59.3
6,142,316 A * 11/2000 Harbour ..... A47F 1/12 211/59.2
6,142,317 A * 11/2000 Merl ..... A47F 1/126 211/184
6,227,385 B1 * 5/2001 Nickerson ..... A47F 1/126 108/61
6,325,221 B2 * 12/2001 Parham ..... 211/183
6,357,606 B1 * 3/2002 Henry ..... A47F 1/126 211/184
6,409,027 B1 * 6/2002 Chang ..... A47F 1/126 211/184
6,464,089 B1 * 10/2002 Rankin, VI ..... A47F 1/126 211/59.3
6,523,702 B1 * 2/2003 Primiano ..... A47F 1/12 211/175
6,615,995 B2 * 9/2003 Primiano ..... A47F 1/12 211/175
6,622,874 B1 * 9/2003 Hawkinson ..... A47F 1/126 211/175
6,695,152 B1 * 2/2004 Fabrizio ..... A47F 1/12 211/175
6,715,621 B2 * 4/2004 Boron ..... A47F 1/12 211/175
6,769,552 B1 * 8/2004 Thalenfeld ..... A47F 1/126 211/183
6,772,888 B2 * 8/2004 Burke ..... A47F 1/126 211/51
6,779,670 B2 * 8/2004 Primiano ..... A47F 1/12 211/175
6,886,699 B2 * 5/2005 Johnson ..... A47F 1/126 108/61
6,889,854 B2 * 5/2005 Burke ..... A47F 1/126 211/59.3
6,923,330 B1 * 8/2005 Nagel ..... A47F 1/126 211/59.3
6,962,260 B2 * 11/2005 Jay ..... A47B 96/021 211/59.2
6,964,235 B2 * 11/2005 Hardy ..... A47F 1/126 108/61
7,083,054 B2 * 8/2006 Squitieri ..... A47F 5/005 211/184
7,093,546 B2 * 8/2006 Hardy ..... A47F 1/126 108/60
7,168,579 B2 * 1/2007 Richter ..... A47F 1/126 211/59.3
7,182,209 B2 * 2/2007 Squitieri ..... A47F 5/005 211/184
7,681,744 B2 * 3/2010 Johnson ..... A47F 1/126 211/59.3
D613,101 S * 4/2010 Hardy ..... D6/515
D613,102 S * 4/2010 Hardy ..... D6/515
7,784,623 B2 * 8/2010 Mueller ..... A47F 1/126 108/61
7,823,734 B2 * 11/2010 Hardy ..... A47F 1/126 211/59.3
D630,458 S * 1/2011 Hardy ..... D6/515
7,891,503 B2 * 2/2011 Hardy ..... A47F 1/126 211/59.3
7,931,156 B2 * 4/2011 Hardy ..... A47F 1/126 211/59.3
8,066,128 B2 * 11/2011 Crawbuck ..... A47F 1/125 211/59.2
8,096,427 B2 * 1/2012 Hardy ..... A47F 1/126 211/59.3
8,127,944 B2 * 3/2012 Hardy ..... A47F 1/04 211/59.3
8,312,999 B2 * 11/2012 Hardy ..... A47F 1/126 211/59.3
8,322,544 B2 * 12/2012 Hardy ..... A47F 1/126 211/184
8,360,253 B2 * 1/2013 Hardy ..... A47F 1/04 211/59.3
8,561,817 B1 * 10/2013 Allen ..... A47F 1/126 211/59.3
8,662,319 B2 * 3/2014 Hardy ..... A47F 1/126 211/184
2001/0010302 A1 * 8/2001 Nickerson ..... A47F 1/126 211/59.3
2002/0088762 A1 * 7/2002 Burke ..... A47F 1/126 211/59.3
2002/0108916 A1 * 8/2002 Nickerson ..... A47F 1/126 211/59.3
2002/0179553 A1 * 12/2002 Squitieri ..... A47F 5/005 211/59.2
2003/0010732 A1 * 1/2003 Burke ..... A47F 1/126 211/59.3
2003/0080075 A1 * 5/2003 Primiano ..... A47F 1/12 211/59.2
2003/0085187 A1 * 5/2003 Johnson ..... A47F 1/126 211/59.3
2004/0004046 A1 * 1/2004 Primiano ..... A47F 1/12 211/59.2
2004/0020877 A1 * 2/2004 Boron ..... A47F 1/12 211/59.2
2004/0118794 A1 * 6/2004 Hardy ..... A47F 1/126 211/59.3
2005/0092703 A1 * 5/2005 Mueller ..... A47F 5/005 211/59.3
2005/0286700 A1 * 12/2005 Hardy ..... A47F 1/126 379/202.01
2007/0068885 A1 * 3/2007 Busto ..... A47F 1/125 211/59.3
2007/0175840 A1 * 8/2007 Richter ..... A47F 1/126 211/59.3

(56) References Cited

U.S. PATENT DOCUMENTS

| | | | | |
|---|---|---|---|---|
| 2008/0156752 | A1* | 7/2008 | Bryson | A47F 1/126 211/59.3 |
| 2009/0184069 | A1* | 7/2009 | Hardy | A47F 1/126 211/59.3 |
| 2011/0094980 | A1* | 4/2011 | Cousin | A47F 5/005 211/59.2 |
| 2011/0139736 | A1* | 6/2011 | Hardy | A47F 1/126 211/59.3 |
| 2011/0215060 | A1* | 9/2011 | Niederhuefner | G08B 13/14 211/59.3 |

FOREIGN PATENT DOCUMENTS

| | | | | | |
|---|---|---|---|---|---|
| EP | 1174060 | A1 | | 1/2002 | |
| EP | 1208773 | A1 | | 5/2002 | |
| EP | 1312285 | A1 | | 5/2003 | |
| FR | 2617385 | A1 | * | 1/1989 | A47F 1/126 |
| FR | EP 0986980 | A1 | * | 3/2000 | A47F 1/126 |
| GB | 2290077 | A | | 12/1995 | |
| GB | WO 0143598 | A1 | * | 6/2001 | A47F 1/126 |
| GB | 2360514 | A | * | 9/2001 | A47F 1/126 |
| SE | EP 1208773 | A1 | * | 5/2002 | A47F 1/126 |
| SE | EP 1312285 | A1 | * | 5/2003 | A47F 1/126 |
| WO | WO 9115141 | A1 | * | 10/1991 | A47F 1/126 |
| WO | WO 9613188 | A1 | * | 5/1996 | A47F 1/126 |
| WO | 02/091885 | A1 | | 11/2002 | |
| WO | WO 2007106751 | A2 | * | 9/2007 | A47F 1/126 |

* cited by examiner

MERCHANDISING SYSTEM WITH PUSHER ASSEMBLY

CROSS-REFERENCE TO RELATED APPLICATIONS

The present application is a continuation-in-part of U.S. patent application Ser. No. 14/725,012, filed on May 29, 2015, now U.S. Pat. No. 9,392,882, which is a continuation of U.S. patent application Ser. No. 13/915,134, filed on Jun. 11, 2013, now U.S. Pat. No. 9,107,516, the entire content of each of which being incorporated by reference herein.

BACKGROUND

The present disclosure relates generally to displaying products on a shelf. More particularly, the present disclosure relates to storing and/or displaying products to provide for the space-efficient presentation of groups of products within a given or fixed display area, and/or allowing for convenient and orderly presentation, dispensing, stocking, and storage of products.

Various types of product merchandisers are commonly used in retail environments to display different types of products. As opposed to simply positioning products on shelves, product displays are commonly used to position products on a shelf in manner which automatically advances (e.g., via gravity or a pusher) a trailing or distal product (i.e., a product that is behind a lead or proximal-most product) closer to a user once the lead product has been removed from the shelf. As can be appreciated, such product displays facilitate the arrangement and upkeep of products, as the trailing products do not have to be manually moved towards the front of the shelf, for instance.

SUMMARY

The present disclosure relates to a merchandising system. The merchandising system includes a track and a pusher member. The track defines a longitudinal axis and includes a plurality of tabs. Each tab of the plurality of tabs includes a width that is perpendicular to the longitudinal axis. The pusher member is configured to slide longitudinally with respect to the track. The pusher member includes at least one leg configured to mechanically engage the track. The track includes a discontinuity to facilitate remove of the pusher member from the track. The discontinuity includes at least one other tab having a width less than a width of an adjacent tab of the plurality of tabs.

In disclosed embodiments, the discontinuity is spaced from a proximal-most end of the track, and the discontinuity is spaced from a distal-most end of the track.

It is further disclosed that the merchandising system further includes a base having a product-supporting surface. The track is disposed beneath the product-supporting surface of the base. In embodiments, the pusher member includes a base-contacting surface. The at least one leg of the pusher member depends downwardly from the base-contacting surface.

It is also disclosed that the track extends proximally of the discontinuity, and the track extends distally of the discontinuity.

In disclosed embodiments, the at least one leg of the pusher member includes a substantially L-shaped cross-section.

It is further disclosed that the merchandising system further includes a proximal member disposed adjacent a proximal-most end of the base. It is also disclosed that the proximal member is integrally formed with the base.

In disclosed embodiments, the base includes at least one slot extending therethrough in a direction that is perpendicular to the longitudinal axis. It is also disclosed that the merchandising system includes a support member configured to engage the at least one slot. It if further disclosed that the at least one slot includes a lower ledge configured to engage the support member.

In disclosed embodiments, the merchandising system further includes a biasing member mechanically coupled to the pusher member and the proximal member. The biasing member is configured to bias the pusher member proximally.

It is further disclosed that the base includes at least three slots extending therethrough in a direction that is perpendicular to the longitudinal axis. In embodiment, the merchandising system includes three support members, where each support member is configured to engage one slot of the at least three slots.

The present disclosure also relates to a merchandising system comprising at least two guide assemblies and at least one support member. Each guide assembly includes a track and a pusher member. The track defines a longitudinal axis and includes a plurality of tabs. Each tab of the plurality of tabs includes a width that is perpendicular to the longitudinal axis. The pusher member is configured to slide longitudinally with respect to the track. The track includes a discontinuity to facilitate removal of the pusher member from the track. The discontinuity includes at least one other tab having a width less than a width of an adjacent tab of the plurality of tabs. The at least one support member is configured to engage each guide assembly of the at least two guide assemblies at a location beneath the track.

In disclosed embodiments, the support member is positioned in a direction that is substantially perpendicular to the longitudinal axis.

It is further disclosed that the merchandising system includes a base having a product-supporting surface. The track is disposed beneath the product-supporting surface of the base. In is also disclosed that the base includes at least one slot extending therethrough in a direction that is perpendicular to the longitudinal axis. The at least one support member is configured to engage the at least one slot.

In disclosed embodiments, the pusher member includes at least one leg configured to mechanically engage the track.

It is further disclosed that the merchandising system includes a proximal member disposed adjacent a proximal-most end of the base. The proximal member is integrally formed with the base.

BRIEF DESCRIPTION OF DRAWINGS

Embodiments of the present disclosure are described hereinbelow with reference to the drawings wherein.

DESCRIPTION

Embodiments of the presently disclosed merchandising system are described in detail with reference to the drawings wherein like numerals designate identical or corresponding elements in each of the several views. As is common in the art, the term "proximal" refers to that part or component closer to the user, e.g., customer, while the term "distal" refers to that part or component farther away from the user.

Figure 1:
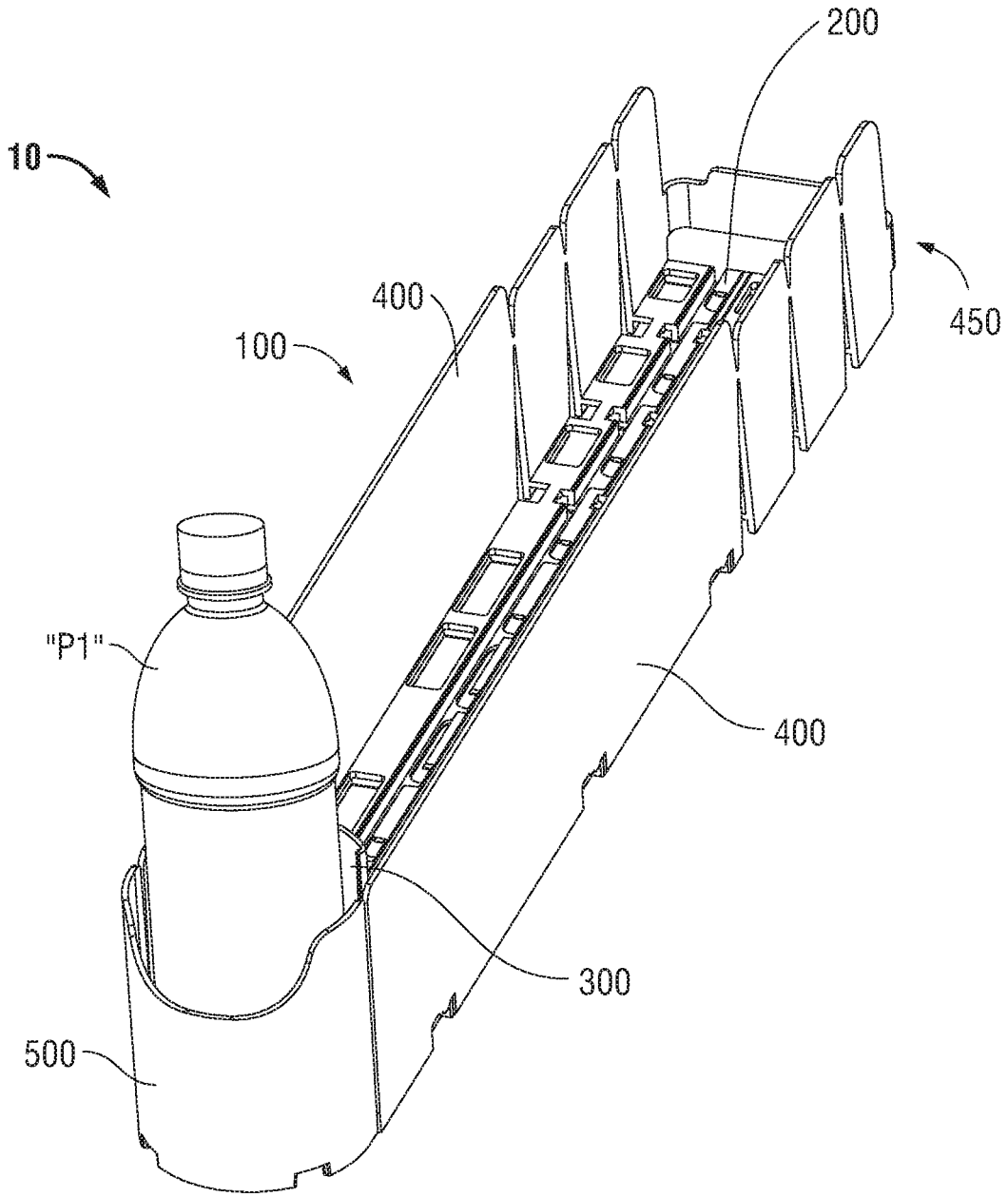
FIG. 1 is a perspective view of a merchandising system including one guide assembly for displaying items on a shelf according to embodiments of the present disclosure, and illustrated including one bottle thereon.
Figure 2A:
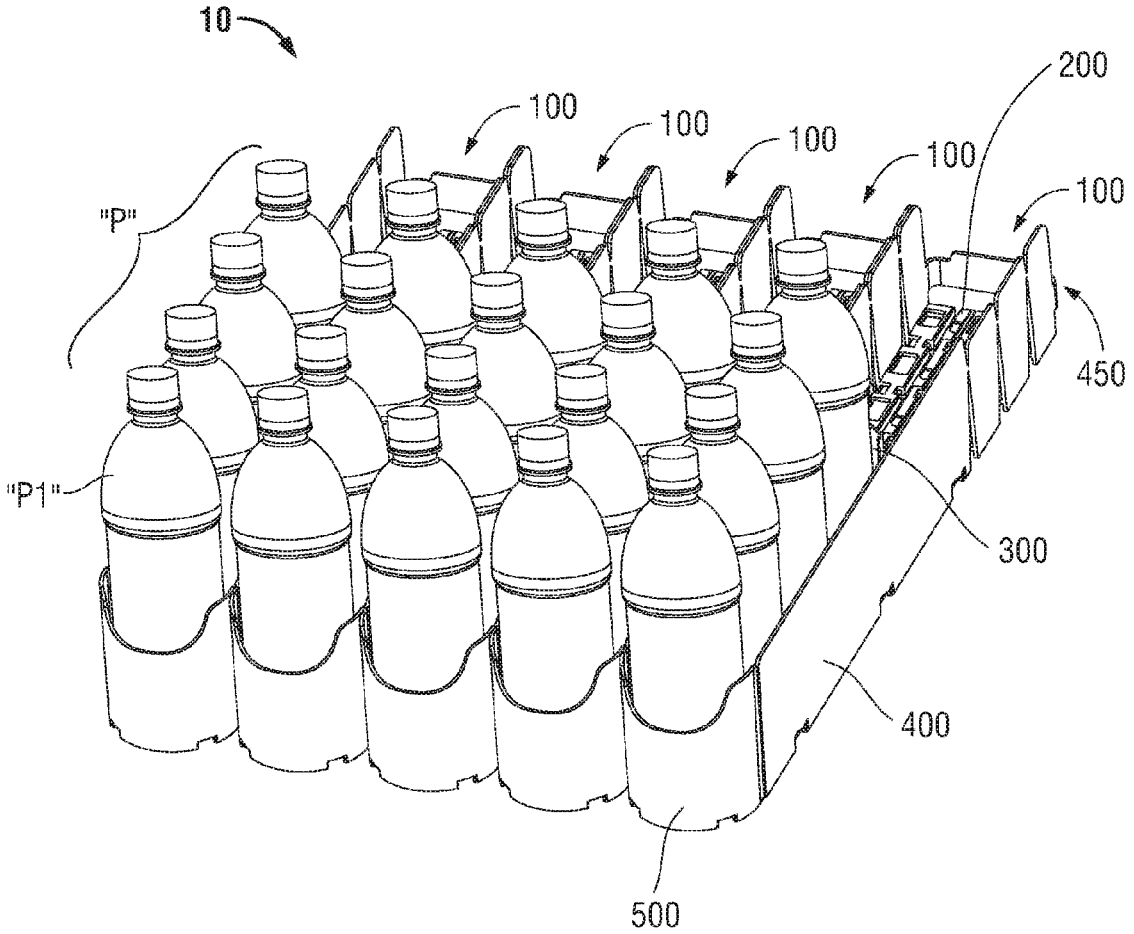
FIG. 2A is a perspective view of the merchandising system of FIG. 1 including five guide assemblies with a plurality of bottles thereon.
Figure 2B:
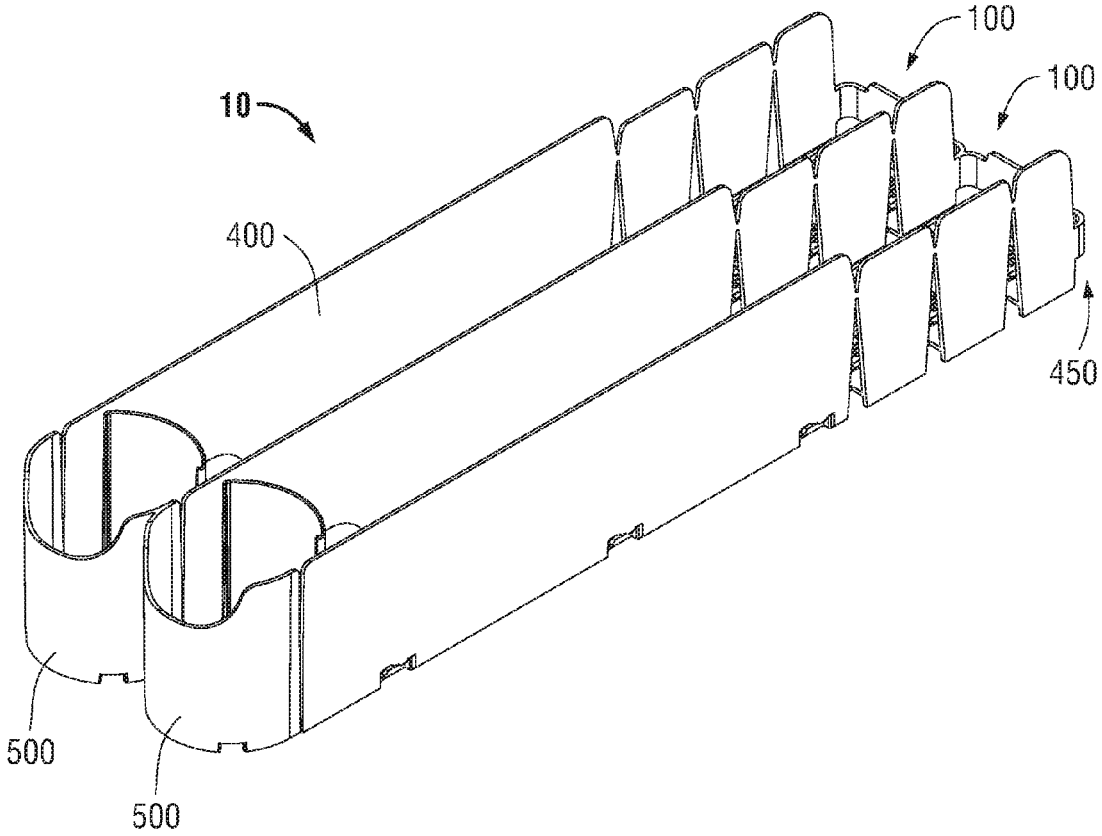
FIG. 2B is a perspective view of the merchandising system of FIGS. 1 and 2 including two guide assemblies with no bottles thereon.
Figure 3:
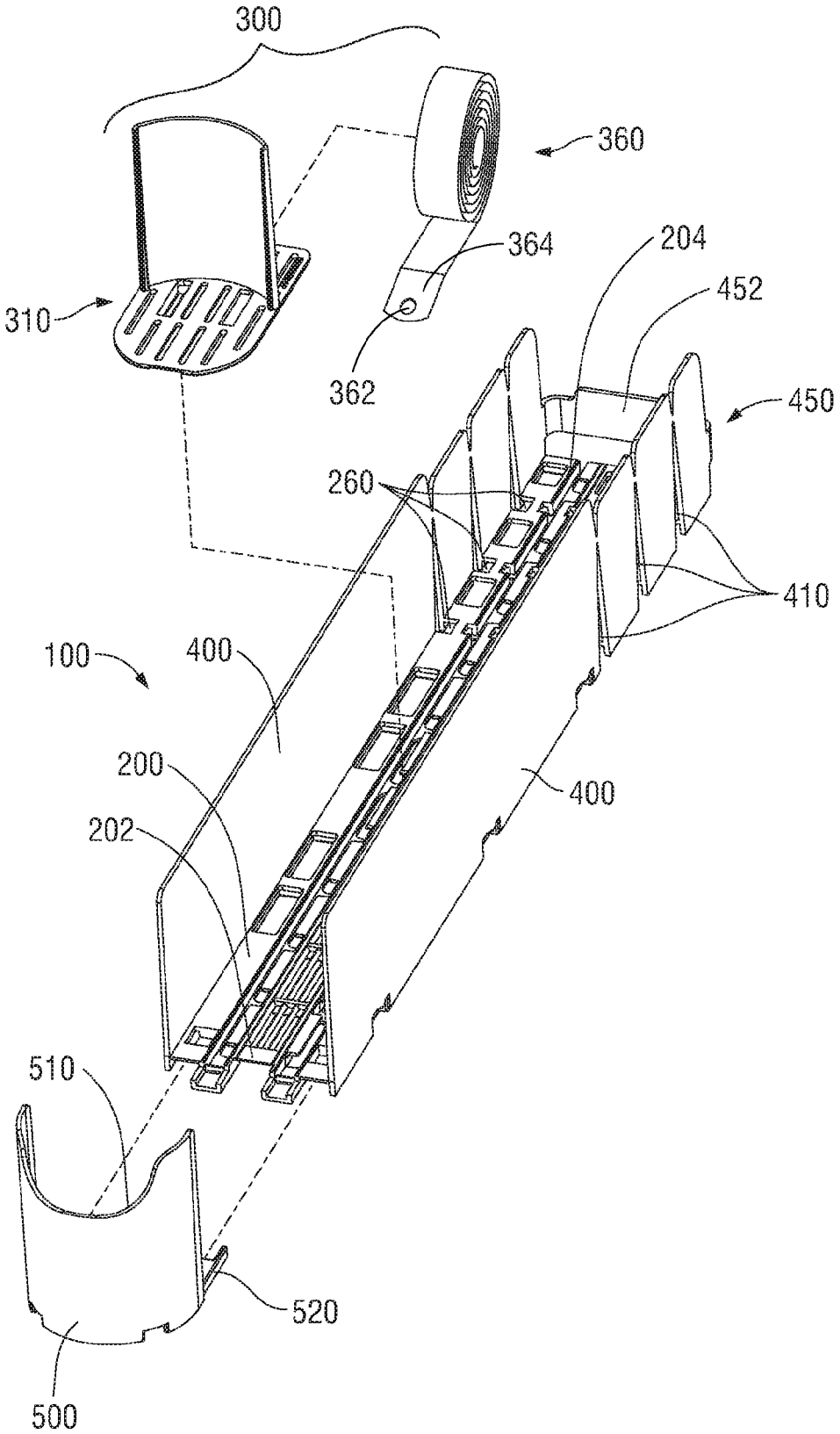
FIG. 3 is a perspective, assembly view of one guide assembly of the merchandising system.

Generally, with particular reference to FIGS. 1-3, a merchandising system 10 is disclosed that includes a plurality of guide assemblies 100. Each guide assembly 100 includes a base 200, a pusher assembly 300, a pair of lateral guides 400, a distal section 450, and a proximal member 500. The base 200, which is designed to be placed on a horizontal or included store shelf, is configured to support a plurality of products "P" thereon. The pusher assembly 300 is configured to urge product(s) "P" on the base 200 toward the proximal member 500. The lateral guides 400 are disposed in mechanical cooperation with base 200 (e.g., are integrally formed therewith, connectable thereto, etc.) and help maintain the products "P" on the base 200. A distal rail 452 of the distal section 450 and the proximal member 500 are also configured to help maintain the products "P" on the base 200.

One merchandising system 10 includes a plurality guide assemblies 100. In the embodiment illustrated in FIG. 2A, merchandising system 10 includes five guide assemblies 100, which, as shown, includes six lateral guides 400. In disclosed embodiments, merchandising system 10 includes more or fewer than five guide assemblies 100 and that the number of lateral guides 400 equals one more than the number of guide assemblies 100. As can be appreciated, several merchandising systems 10 are able to be positioned adjacent one another on a shelf.

With reference to FIGS. 4-9, the base 200 includes a product-supporting surface 210, a lower surface 220, a gap 230, a plurality of longitudinally extending ribs 240, and a track 250. The product-supporting surface 210 is the portion of the base on which products "P" are positioned. The lower surface 220 is the underside of the base 200. The gap 230 is the space between the product-supporting surface 210 and the lower surface 220. The ribs 240 extend along at least a portion of the base 200 between a proximal end 202 of the base 200 and a distal end 204 of the base 200 (see FIG. 3), and are configured to provide stability to base 200 and to reduce friction when a product "P" slides along the product-supporting surface 210, for example. The track 250 includes a plurality of spaced-apart tabs 252 that are positioned within the gap 230. The track 250 is configured to guide legs 340 of the pusher assembly 300 (as discussed in further detail below).

Figure 4:
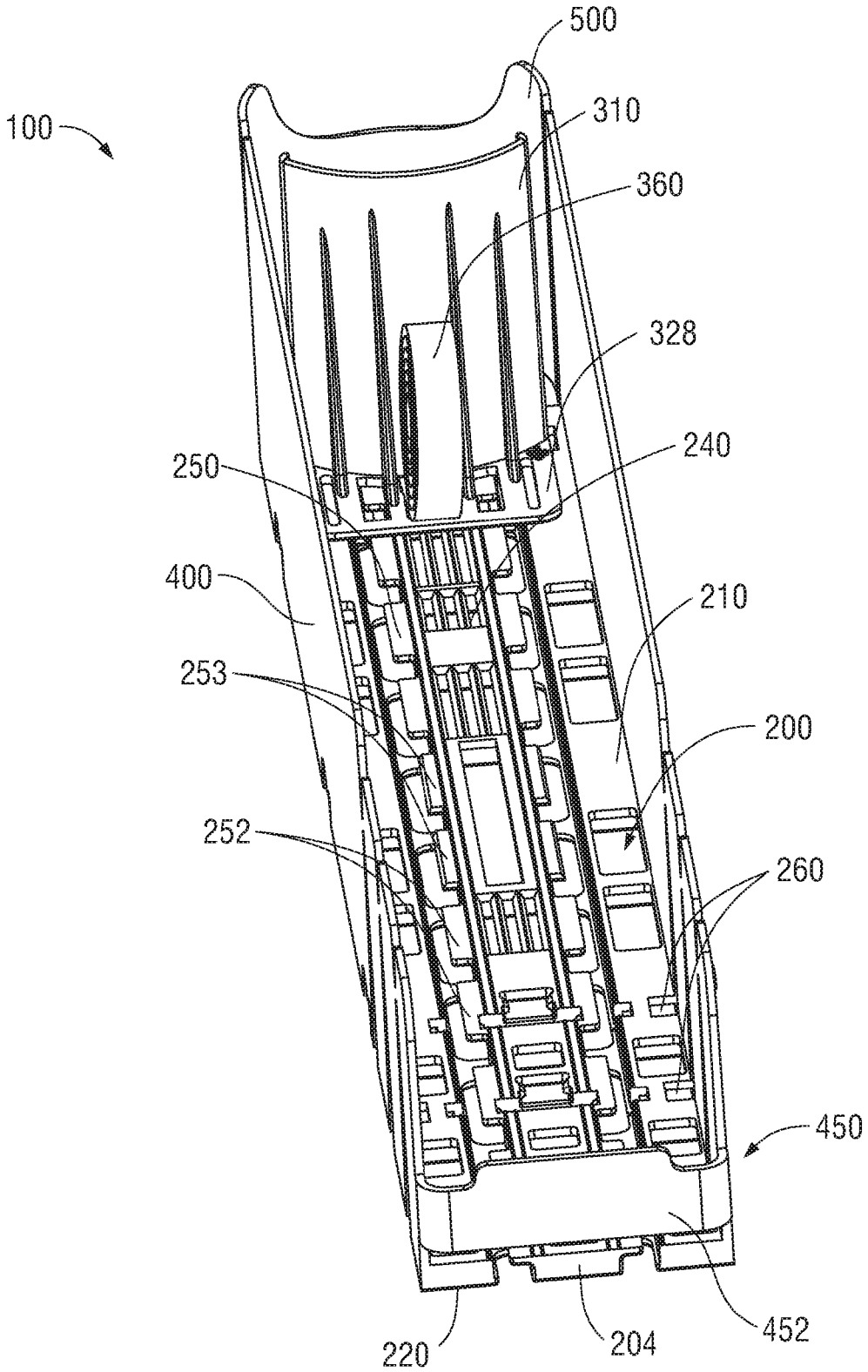
FIG. 4 is a perspective view, viewed from the rear, of one guide assembly of the merchandising system.
Figure 5:
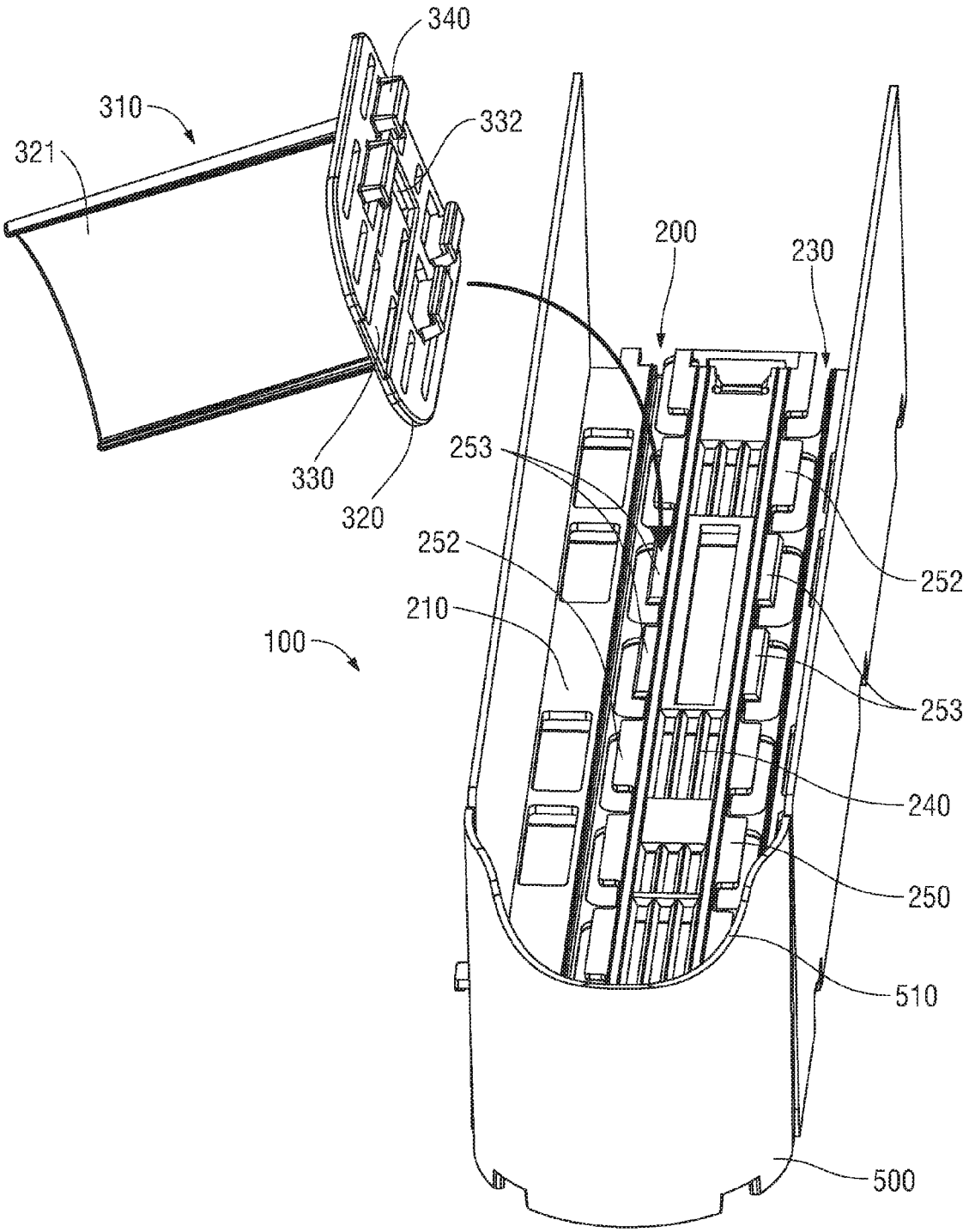
FIG. 5 is a perspective view of one guide assembly of the merchandising system showing a pusher assembly separated from the remainder of the guide assembly.
Figure 6:
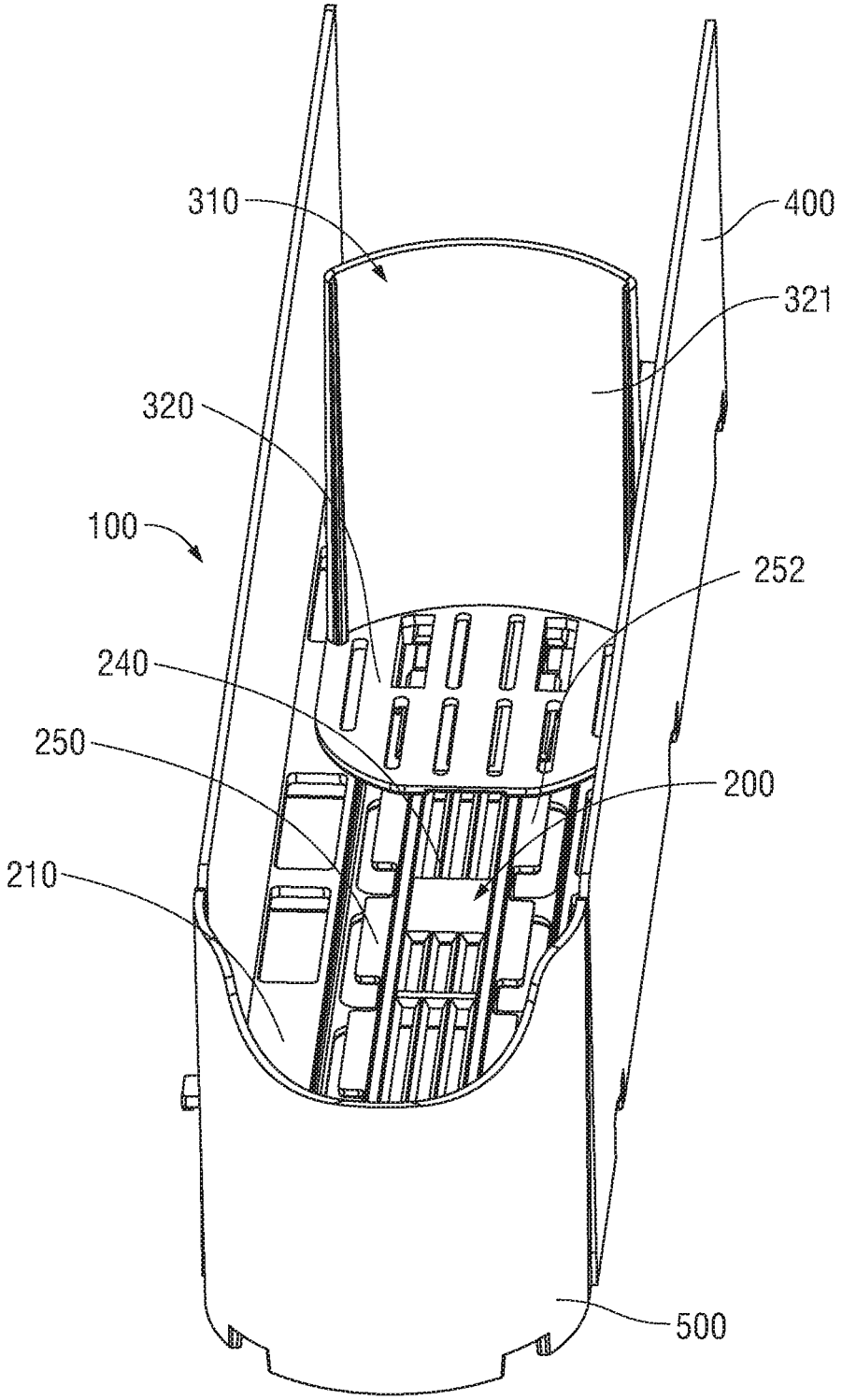
FIG. 6 is a perspective view of a portion of one guide assembly illustrating the pusher assembly in an intermediate position.
Figure 7:
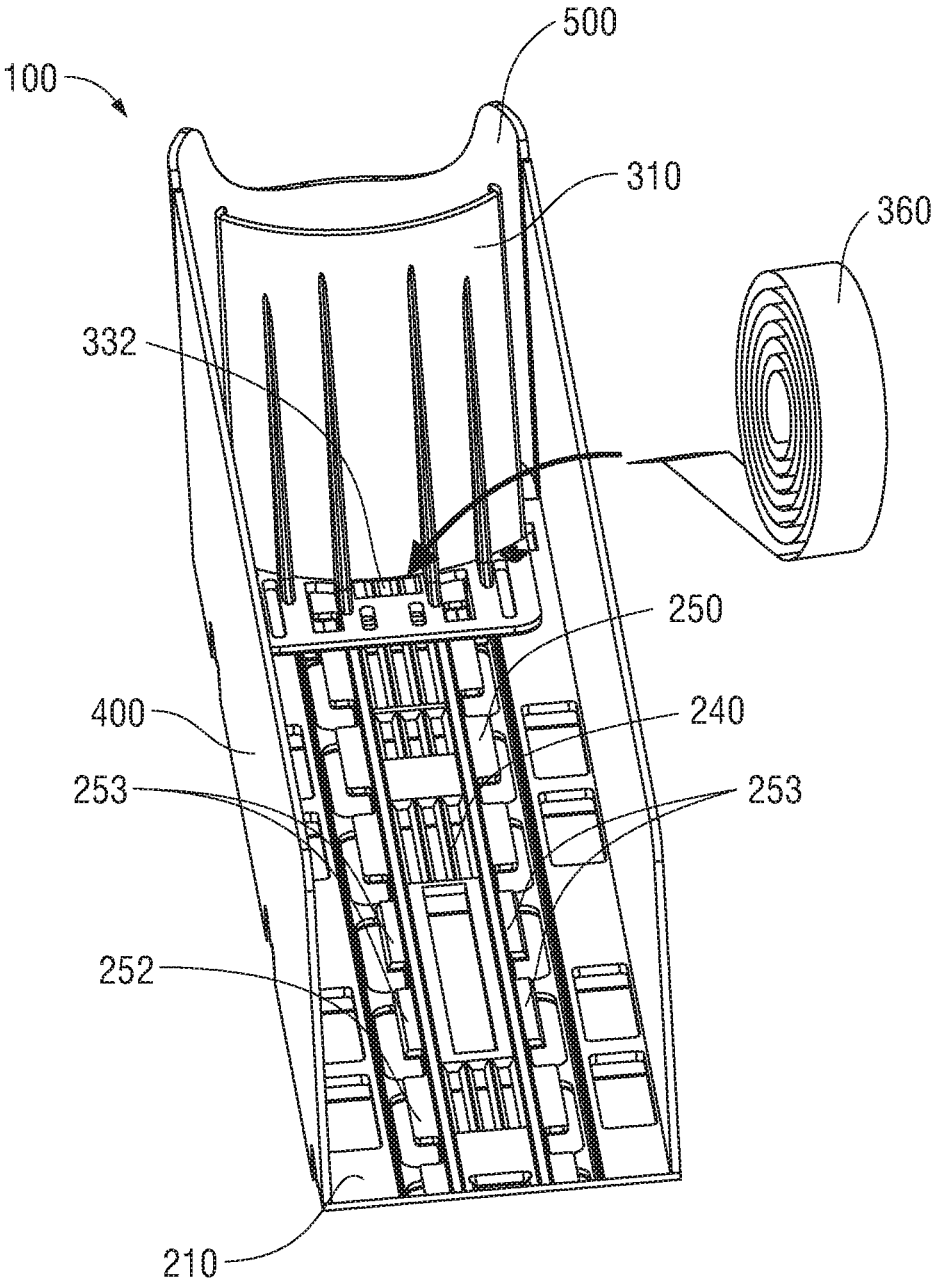
FIG. 7 is a perspective view, viewed from the rear, of the portion of the guide assembly of FIG. 6 showing a biasing member separated from the remainder of the guide assembly.

Referring now to FIGS. 3-13, the pusher assembly 300 includes a pusher member 310 and a biasing member 360 (e.g., a coiled spring). Pusher member 310 includes a horizontal member 320 and a substantially vertical member 321. In the illustrated embodiment, the vertical member 321 has an arcuate shape, which is configured to correspond to the contour of the product "P" (e.g., bottle) supported thereagainst. The horizontal member 320 includes an upper surface 322 (e.g., for supporting a product "P"), and a lower surface (or base-contacting surface) 324 that is configured to longitudinally slide along the product-supporting surface 210 of the base 200. The horizontal member 320 also includes a proximal portion 326, and a distal portion 328. The proximal portion 326 is configured to support a distal-most product "P" thereon, and the distal portion 328 supports at least a portion of the biasing member 360 thereon (FIG. 4). The horizontal member 320 also includes a track 330 (FIGS. 5 and 11) within its lower surface 324, and an opening 332 (FIGS. 5, 7 and 11) extending between the upper surface 322 and the lower surface 324. A portion of the biasing member 360 extends through the opening 332 and along the track 330.

Figure 11:
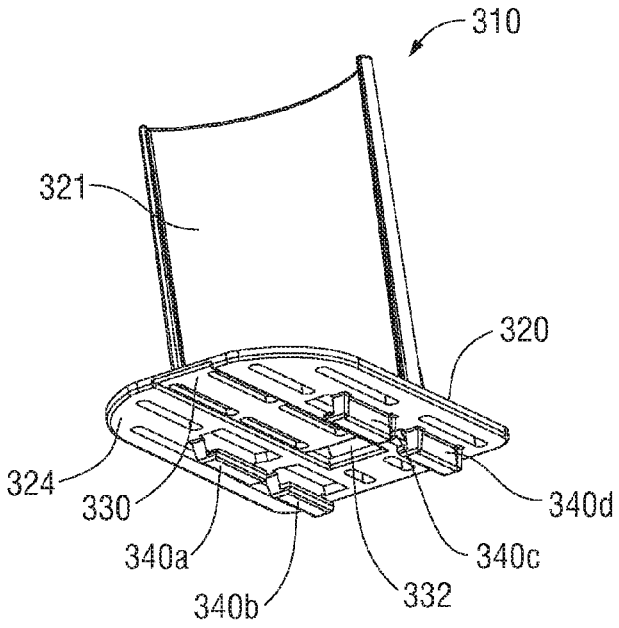
Figure 12:
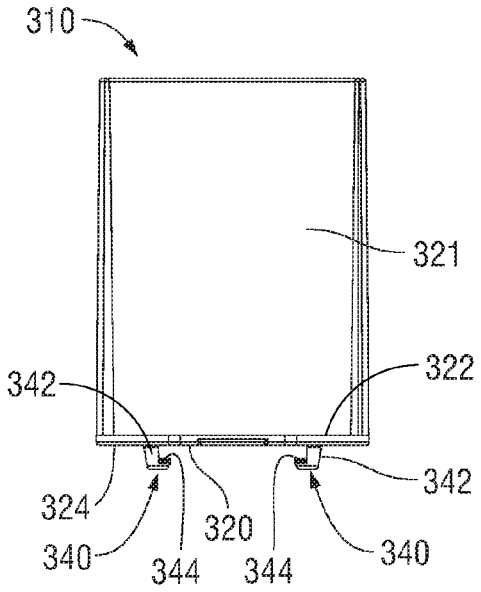
FIG. 12 is a front view of the pusher assembly of FIGS. 10 and 11.
Figure 13:
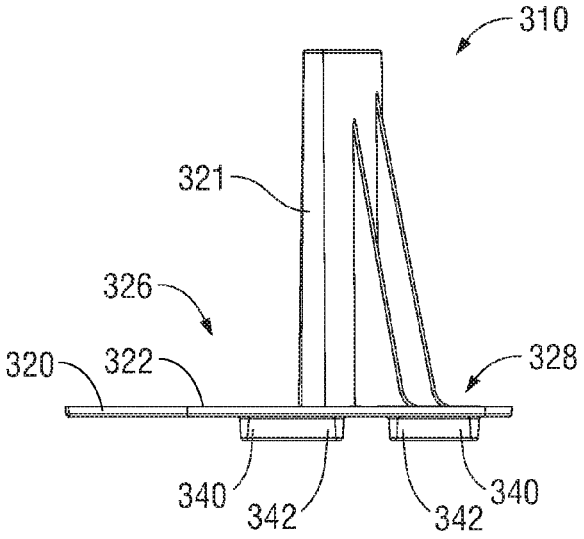
FIG. 13 is a side view of the pusher assembly of FIGS. 10-12.

The pusher member 310 also includes a plurality of legs 340 (FIGS. 5, 8A, 8B, 9 and 11-13) that extend below the lower surface 324 of the horizontal member 320. With particular reference to FIG. 11, the pusher assembly 300 includes a first leg 340*a*, a second leg 340*b*, a third leg 340*c* and a fourth leg 340*d*. In the illustrated embodiments, each leg 340 includes a vertical portion 342, and a horizontal portion 344 (FIG. 12) extending inwardly from the vertical portion 342, such that each leg 340 includes a substantially L-shaped cross-section. When the pusher assembly 300 is engaged with the base 200, the legs 340 of the pusher assembly 300 extend below the product-supporting surface 210 of the base 200 and mechanically engage the tabs 252 of the track 250, and are longitudinally slidable along the track 250. More particularly, and with particular reference to FIG. 9, when the pusher assembly 300 and the base 200 are mechanically engaged, the vertical portion 342 of each leg 340 abuts or is adjacent a lateral wall 254 of the tab 252, and the horizontal portion 344 of each leg 340 abuts or is adjacent a lower wall 256 of the tab 252.

This engagement between the legs 340 of the pusher member 310 and the track 250 of the base 200 helps ensure the pusher member 310 remains on the base 200 during use of the merchandising system 10. More particularly, when torque is applied to the merchandising system (e.g., during loading of the merchandising system 10 with products "P," when a consumer's shopping cart bumps into the merchandising system 10 or the shelf that the merchandising system 10 is positioned on, etc.) the engagement between the pusher member 310 (e.g., the legs 340) and the base 200 (e.g., the track 250) helps prevent the pusher member 310 from toppling over. For instance, when a downward force is applied to right side of the pusher member 310 (e.g., during torquing of the merchandising system 10), the legs 340*a* and 340*b* on the left side of the pusher member 310 are forced upward. There engagement between the horizontal portions 344 of these legs 340*a* and 340*b* and the lower wall 256 (FIG. 9) of a tab 252 of the track 250 helps prevent the pusher member 310 from becoming separated from the base 200 at that location. Additionally, the engagement between the legs 340 and the track 250 helps prevent the pusher member 310 from intentionally being separated from the base 200 (e.g., by vandals).

With particular reference to FIG. 4, to install the pusher member 310 onto the base 200, a user positions each leg 340 adjacent a shortened tab 253 (i.e., a discontinuity in the track 250), and moves the pusher member 310 proximally or distally such that the horizontal portion 344 of each leg is under a tab 252 or a shortened tab 253 of the track 250. It is envisioned that in lieu of, or in addition to shortened tabs 253, track 250 includes a space between adjacent tabs 252 that is large enough to accommodate the legs 340 of the pusher member 310. It is further envisioned that shortened tabs 253 (and/or the large space) are located at one or a plurality of locations between the proximal end 202 and the distal end 204 of the base 200 (e.g., not the proximal-most portion of the base 200 and not the distal-most portion of the base 200).

With reference to FIG. 3, the proximal member 500 of the merchandising system 10 is configured to attach to a proximal end of the base 200 via a snap-fit connection, for example. It is envisioned that at least a portion of the proximal member 500 is transparent or translucent to allow a consumer to view a portion of the proximal-most product "P1" on the merchandising system 10 therethrough. Additionally, in the illustrated embodiment, the proximal member 500 has an arcuate shape, which is configured to correspond to the contour of the product "P" (e.g., bottle) supported thereagainst. It is also envisioned that the proximal member 500 includes a scooped portion 510. The scooped portion 510 allows the proximal-most product "P1" to be better viewed by a consumer, allows the proximal-most product "P1" to be tipped down by a consumer to facilitate shopping of the products "P," and/or facilitates the loading of the products "P" onto the merchandising system 10, e.g., by a store employee.

Figure 8A:
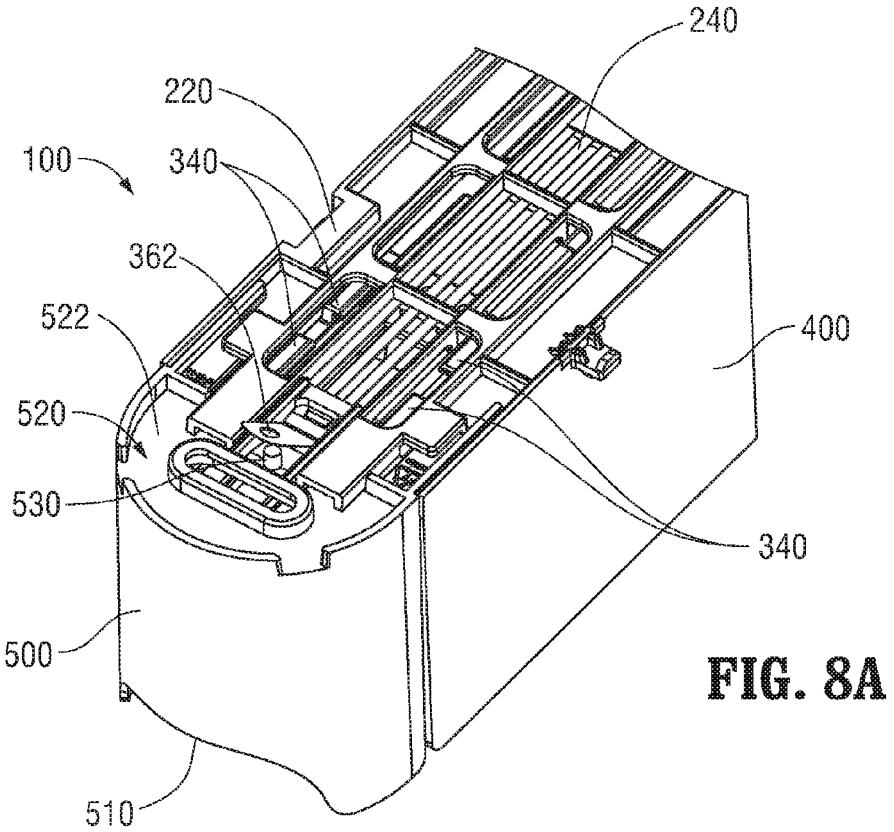
FIG. 8A is a perspective view, viewed from the bottom, of a portion of the guide assembly showing the biasing member separated from a proximal member.
Figure 8B:
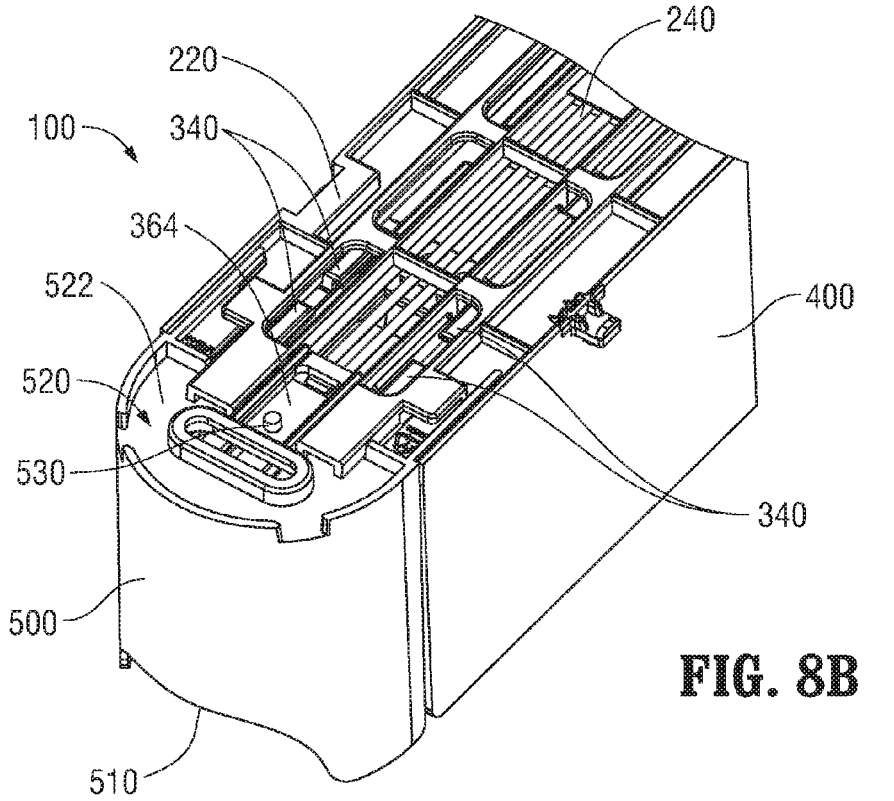
FIG. 8B is a perspective view, viewed from the bottom, of the portion of the guide assembly of FIG. 8A showing the biasing member engaged with the proximal member.
Figure 9:
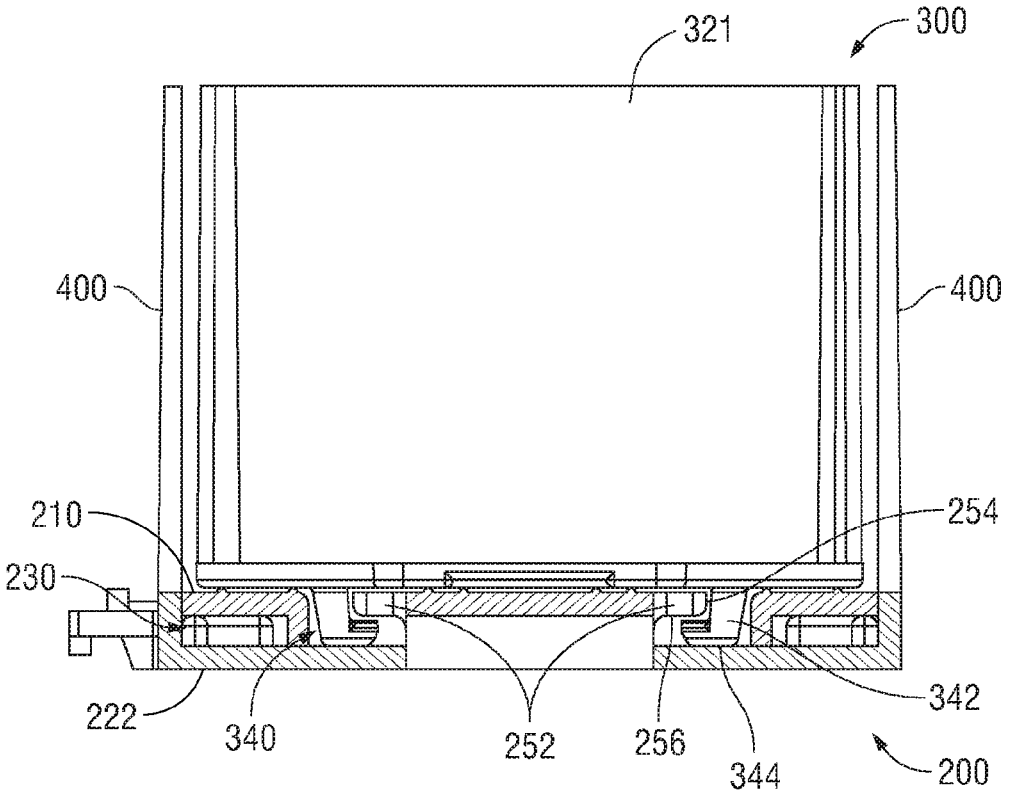
FIG. 9 is a cross-sectional view of the pusher assembly engaged with a base of the guide assembly.
Figure 10:
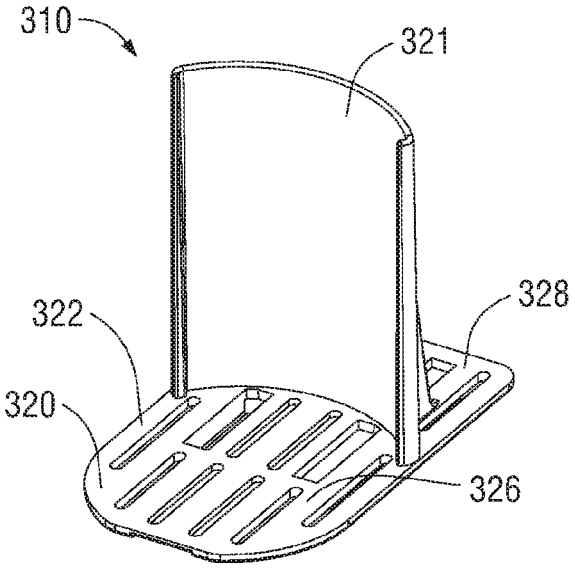
FIGS. 10 and 11 are perspective views of the pusher assembly of the present disclosure.

With particular reference to FIGS. 8A and 8B, a lower surface 522 of a base 520 of the proximal member 500 includes a pin 530 extending downwardly therefrom. The pin 530 is configured to mechanically engage a hole 362 disposed on a proximal portion 364 of the biasing member 360 (see also FIG. 3). Therefore, when the hole 362 is engaged with the pin 530 (FIG. 7B), the biasing member 360, and thus the pusher assembly 300, is mechanically coupled to the proximal member 500.

Additionally, the merchandising system 10 is configured to be used on shelves of various depths (i.e., the distance the shelf extends from the wall/support). Specifically, portions of the guide assemblies 100 are able to be broken-off or otherwise removed to effectively shorten the length of the guide assemblies 100. More particularly, and with reference to FIGS. 3, 4, 14A and 14B, the base 200 includes breakaway features 260, and the lateral guides 400 include breakaway features 410, that each allow for selective removal of portions of the base 200 and the lateral guides 400 to shorten the length of the guide assemblies 100.

Figure 14A:
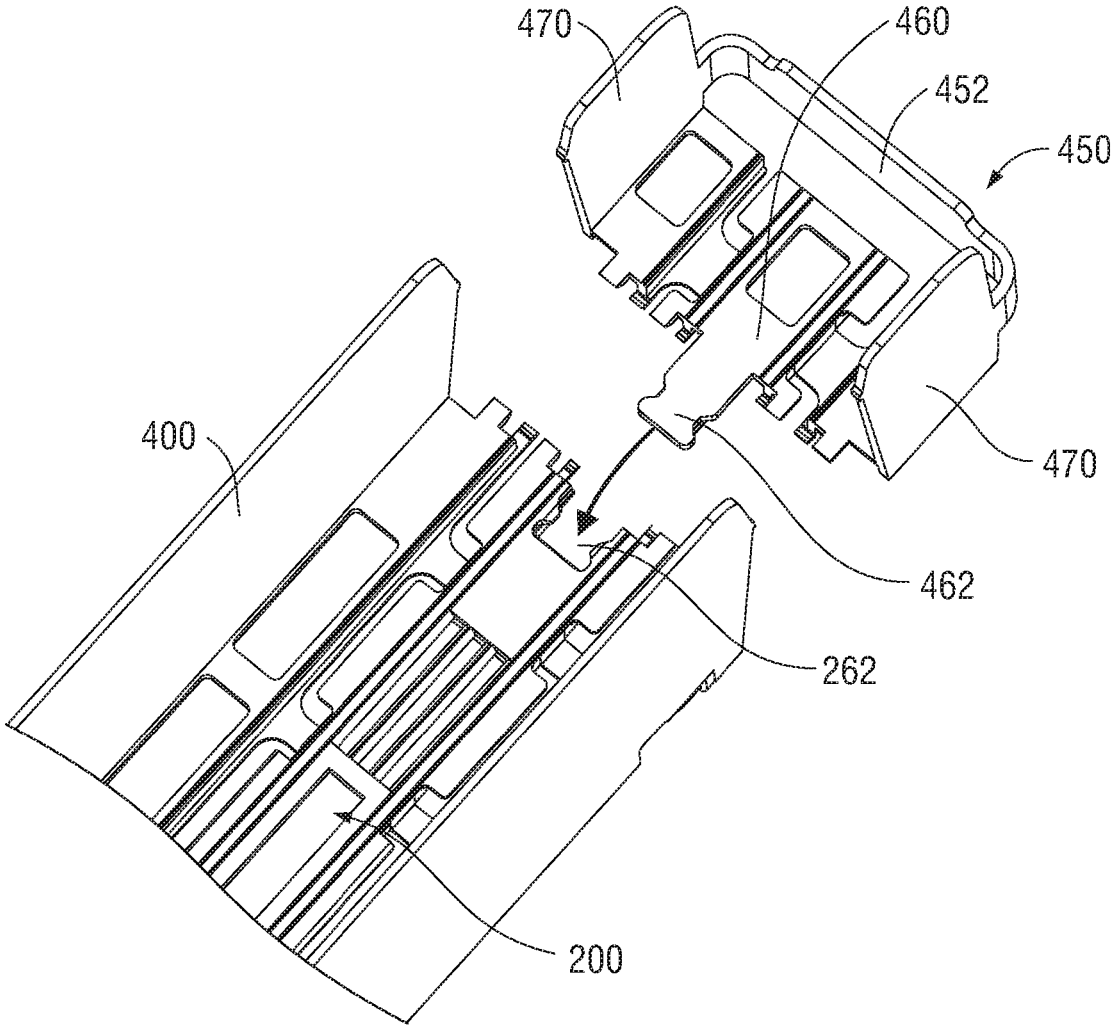
FIG. 14A is a perspective view of a portion of the guide assembly illustrating a distal portion separated from the remainder of the guide assembly.
Figure 14B:
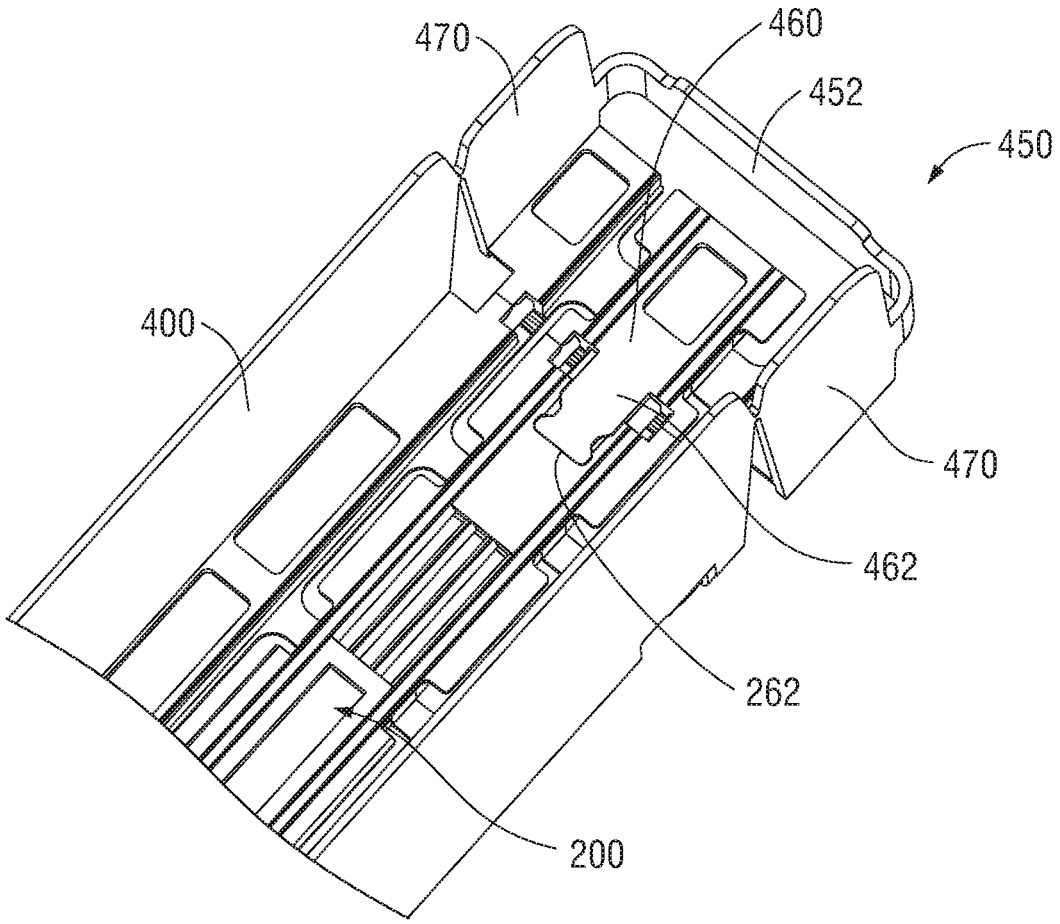
FIG. 14B is a perspective view of the portion of the guide assembly shown in FIG. 14A illustrating the distal portion engaged with the remainder of the guide assembly.

Referring now to FIGS. 14A and 14B, the distal section 450 includes the distal rail 452, a distal base 460, and distal lateral walls 470. The distal base 460 includes a proximally-extending finger 462 that is configured to engage and interlock with a corresponding cut-out 262 disposed at a distal end of the base 200. Accordingly, the distal section 450 is able to be removed (FIG. 14A), and re-installed (FIG. 14B) after one or more portions of the base 200 and lateral guides 400 have been removed.

Further, the pusher assembly 300 of the merchandising system 10 is still able to properly function across the breakaway features 260 and 410, the proximally-extending finger 462 and the cut-out 262, after some or all of the portions of the base 200 and the lateral guides 400 have been removed, and after the distal section 450 has been removed and re-installed.

Figure 15:
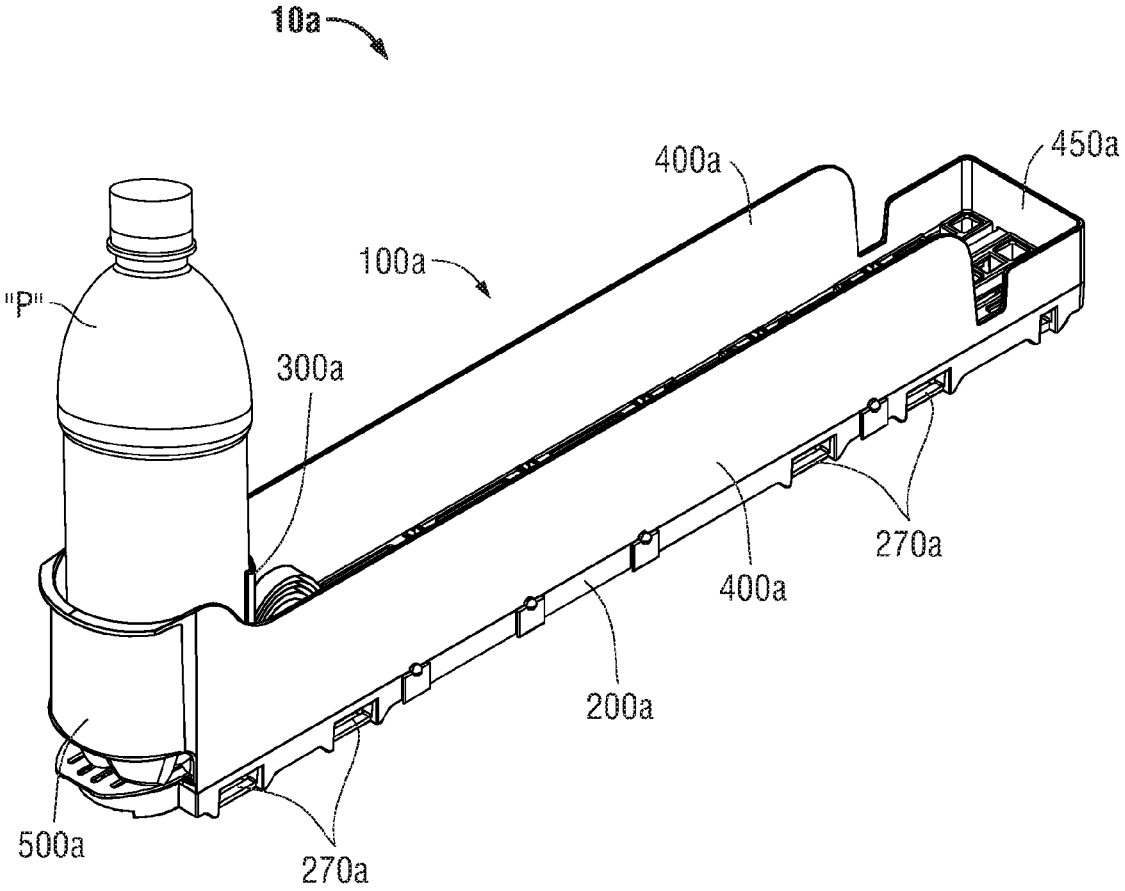
FIG. 15 is a perspective view of a merchandising system including one guide assembly for displaying items on a shelf according to additional embodiments of the present disclosure, and illustrated including one bottle thereon.
Figure 16:
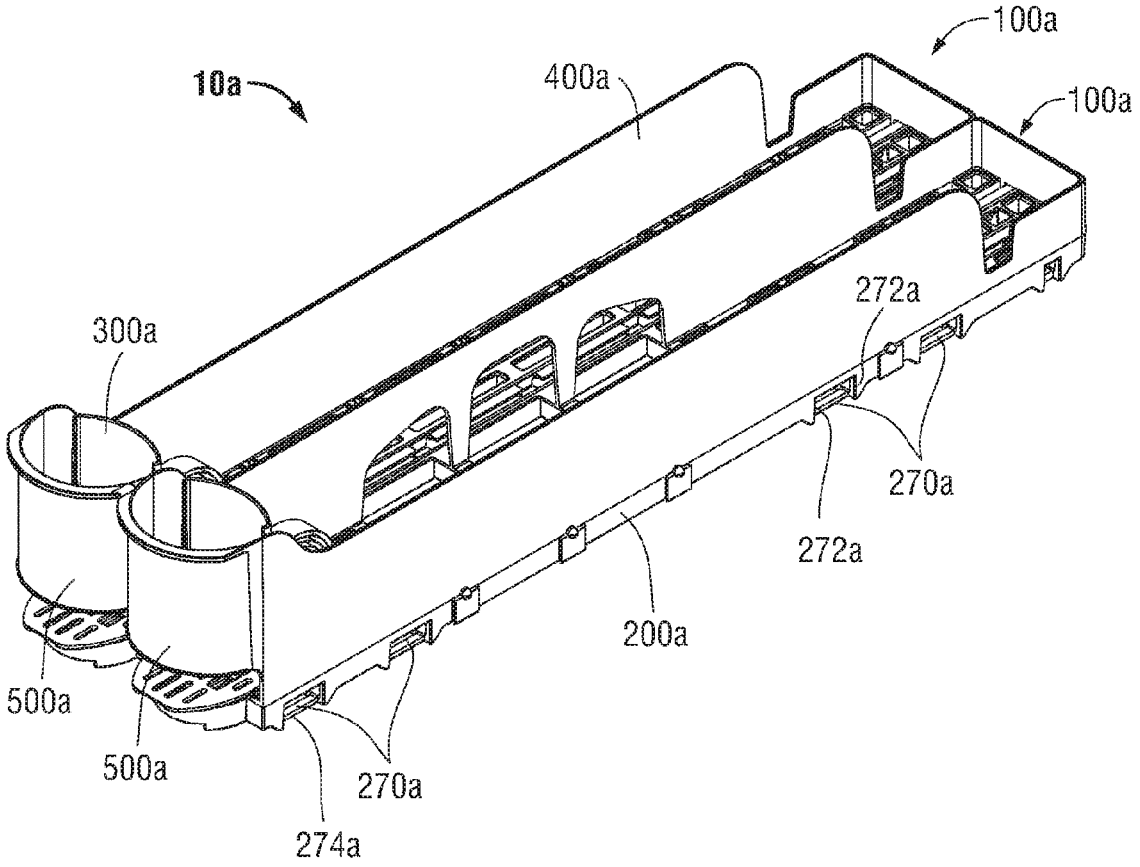
FIG. 16 is a perspective view of the merchandising system of FIG. 15 including two guide assemblies with no bottles thereon.
Figure 17:
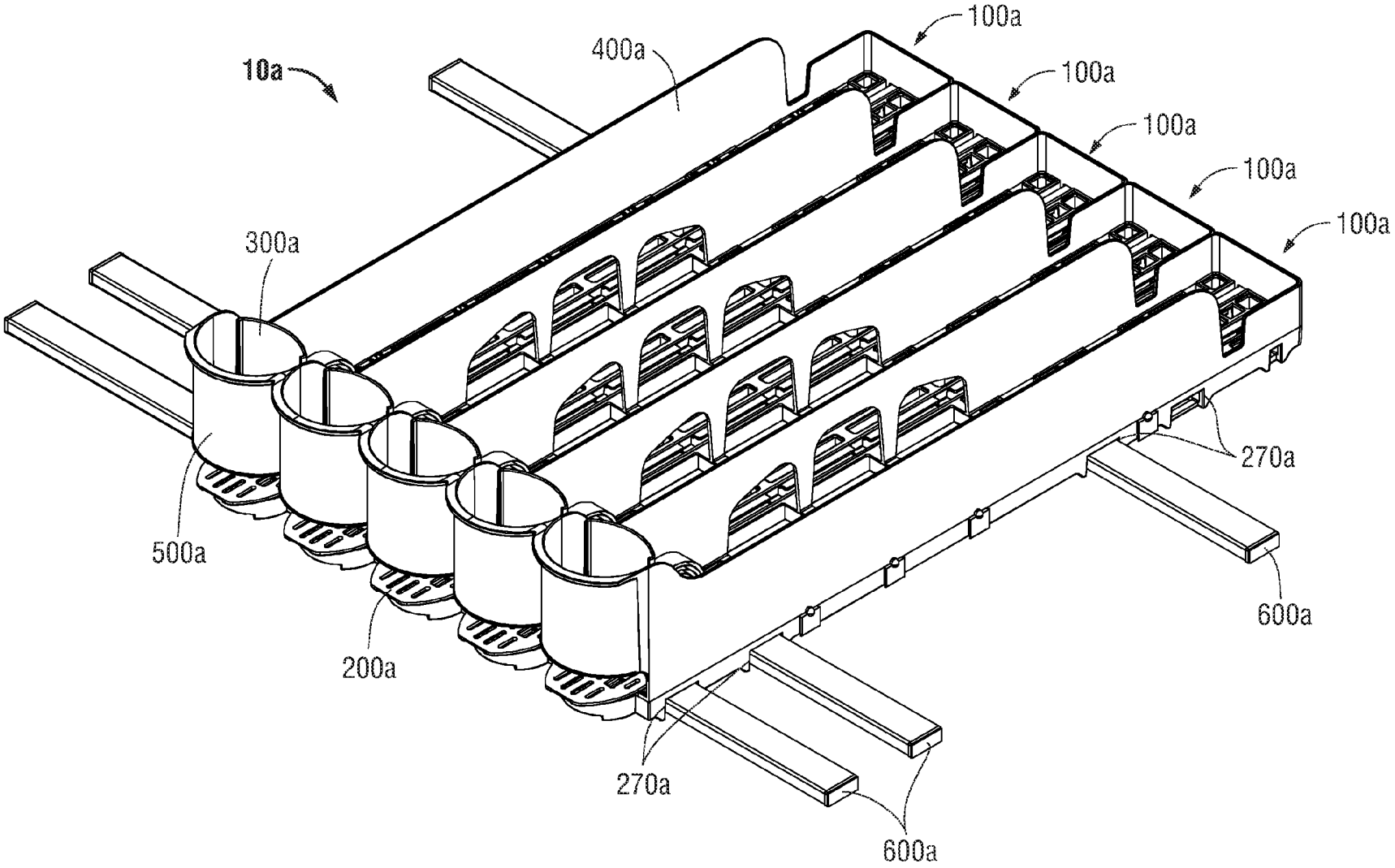
FIG. 17 is a perspective view of the merchandising system of FIGS. 15 and 16 including five guide assemblies with no bottles thereon, and including a plurality of support members engaged with the merchandising system.

Referring now to FIGS. 15-17, an additional embodiment of a merchandising system 10*a* is disclosed. Merchandising system 10*a* includes a plurality of guide assemblies 100*a*. Each guide assembly 100*a* includes a base 200*a*, a pusher assembly 300*a*, a pair of lateral guides 400*a*, a distal section 450*a*, and a proximal member 500*a*. The base 200*a*, which is designed to be placed on a horizontal or included store shelf, is configured to support a plurality of products "P" thereon. The pusher assembly 300*a* is configured to urge product(s) "P" on the base 200*a* toward the proximal member 500*a*. The lateral guides 400*a* are disposed in mechanical cooperation with base 200*a* (e.g., are integrally formed therewith, connectable thereto, etc.) and help maintain the products "P" on the base 200*a*. A distal rail 452*a* of the distal section 450*a* and the proximal member 500*a* are also configured to help maintain the products "P" on the base 200*a*. Common features between merchandising system 10*a* and merchandising system 10, discussed above, will not be further discussed in detail herein.

It is envisioned that several components of merchandising system 10*a* are integrally formed (e.g., not configured to be separated, etc.) with one another. For instance, it is envisioned that proximal member 500*a* is integrally formed with base 200*a*, lateral guides 400*a*, and/or distal section 450*a*.

Base 200*a* of guide assemblies 100*a* includes a plurality of slots 270*a*. Slots 270*a* are disposed generally perpendicular to the direction of travel of products "P" supported by base 200*a*. Each slot 270*a* is configured to allow a support member 600*a* to slide therethrough. It is envisioned that each support member 600*a* is frictionally held in place by walls 272*a* defining slot 270*a*, and/or in connection with a portion of the shelf that supports merchandising system 10*a*. Additionally, each slot 270*a* may include a lower ledge 274*a* that is configured to engage a lower surface of support member 600*a* to help maintain support member 600*a* therein. Further each slot 270*a* is positioned below the track (see track 250), such that slots 270*a* and support members

600*a* do not interfere with the movement of pusher member 300*a* with respect to the track.

Support members 600*a* are configured to increase the stability of merchandising system 10*a*. For instance, the inclusion of at least one support member 600*a* may prevent or minimize buckling of a merchandising system 10*a* heavily-loaded with products "P." While FIGS. 15-17 illustrate merchandising system 10*a* including four slots 270*a* and three support members 600*a*, merchandising system 10*a* may include more or fewer than four slots 270*a*, and more or fewer than three support members 600*a*.

The present disclosure also includes a method of displaying items using the merchandising systems 10, 10*a* described above, and a method of engaging the pusher assemblies 300, 300*a* with the respective base 200, 200*a*, as discussed above.

While several embodiments of the disclosure have been shown in the figures, it is not intended that the disclosure be limited thereto, as it is intended that the disclosure be as broad in scope as the art will allow and that the specification be read likewise. Therefore, the above description should not be construed as limiting, but merely as exemplifications of various embodiments. Those skilled in the art will envision other modifications within the scope and spirit of the claims appended hereto.

The invention claimed is:

1. A merchandising system comprising:

a track defining a longitudinal axis and including a plurality of tabs, each tab of the plurality of tabs including a width that is perpendicular to the longitudinal axis; and a pusher member configured to slide longitudinally with respect to the track, the pusher member including at least one leg configured to mechanically engage the track, wherein the track includes a discontinuity to facilitate removal of the pusher member from the track, the discontinuity including at least one other tab having a width less than a width of an adjacent tab of the plurality of tabs.

2. The merchandising system according to claim 1, wherein the discontinuity is spaced from a proximal-most end of the track, and wherein the discontinuity is spaced from a distal-most end of the track.

3. The merchandising system according to claim 1, further comprising a base having a product-supporting surface, wherein the track is disposed beneath the product-supporting surface of the base.

4. The merchandising system according to claim 3, wherein the pusher member includes a base-contacting surface, the at least one leg of the pusher member depending downwardly from the base-contacting surface.

5. The merchandising system according to claim 1, wherein the track extends proximally of the discontinuity, and wherein the track extends distally of the discontinuity.

6. The merchandising system according to claim 1, wherein the at least one leg of the pusher member includes a substantially L-shaped cross-section.

7. The merchandising system according to claim 3, further comprising a proximal member disposed adjacent a proximal-most end of the base.

8. The merchandising system according to claim 7, wherein the proximal member is integrally formed with the base.

9. The merchandising system according to claim 3, wherein the base includes at least one slot extending therethrough in a direction that is perpendicular to the longitudinal axis.

10. The merchandising system according to claim 9, further comprising a support member configured to engage the at least one slot.

11. The merchandising system according to claim 10, wherein the at least one slot includes a lower ledge configured to engage the support member.

12. The merchandising system according to claim 7, further comprising a biasing member mechanically coupled to the pusher member and the proximal member, the biasing member configured to bias the pusher member proximally.

13. The merchandising system according to claim 3, wherein the base includes at least three slots extending therethrough in a direction that is perpendicular to the longitudinal axis.

14. The merchandising system according to claim 13, further comprising three support members, each support member configured to engage one slot of the at least three slots.

15. A merchandising system comprising:

at least two guide assemblies, each guide assembly of the at least two guide assemblies including:

a track defining a longitudinal axis and including a plurality of tabs, each tab of the plurality of tabs including a width that is perpendicular to the longitudinal axis; and a pusher member configured to slide longitudinally with respect to the track, wherein the track includes a discontinuity to facilitate removal of the pusher member from the track, the discontinuity including at least one other tab having a width less than a width of an adjacent tab of the plurality of tabs; and at least one support member configured to engage each guide assembly of the at least two guide assemblies at a location beneath the track.

16. The merchandising system according to claim 15, wherein the at least one support member is positioned in a direction that is substantially perpendicular to the longitudinal axis.

17. The merchandising system according to claim 15, further comprising a base having a product-supporting surface, wherein the track is disposed beneath the product-supporting surface of the base.

18. The merchandising system according to claim 17, wherein the base includes at least one slot extending therethrough in a direction that is perpendicular to the longitudinal axis, the at least one support member configured to engage the at least one slot.

19. The merchandising system according to claim 15, wherein the pusher member includes at least one leg configured to mechanically engage the track.

20. The merchandising system according to claim 17, further comprising a proximal member disposed adjacent a proximal-most end of the base, wherein the proximal member is integrally formed with the base.

* * * * *